United States Patent [19]

Tschentscher

[11] 4,379,528

[45] Apr. 12, 1983

[54] THREAD REELING APPARATUS

[75] Inventor: Alfred Tschentscher, Cologne, Fed. Rep. of Germany

[73] Assignee: FMN Schuster GmbH & Co. KG, Fed. Rep. of Germany

[21] Appl. No.: 254,565

[22] Filed: Apr. 15, 1981

[30] Foreign Application Priority Data

Apr. 30, 1980 [DE] Fed. Rep. of Germany ..... 3016662

[51] Int. Cl.[3] ..... B65H 54/28

[52] U.S. Cl. ..... 242/43 R; 242/18 DD; 242/45; 242/158.3

[58] Field of Search ..... 242/43 R, 43 A, 43 B, 242/43 M, 18 DD, 158 R, 158.3, 158.5, 45

[56] References Cited

U.S. PATENT DOCUMENTS 3,861,607 1/1975 Schippers et al. ..... 242/43 R

FOREIGN PATENT DOCUMENTS 42-18564 9/1967 Japan ..... 242/43 R

*Primary Examiner*—Stanley N. Gilreath

*Attorney, Agent, or Firm*—Neil F. Markva

[57] ABSTRACT

The thread reeling apparatus includes a rotary cam drum with a traversing thread guide assembly used to guide a thread from a delivery mechanism to a bobbin or thread package. A roller having a smooth, peripheral surface is interposed at a location downstream of the rotary cam drum along which the traversing thread guide assembly moves back and forth. A further traversing thread guide assembly located downstream of the smooth roller receives the thread from the smooth roller and transfers the same on to a bobbin or thread package driven by a friction roller. The disposition of the smooth roller and further traversing thread guide assembly controls the tension of the thread along the thread path.

6 Claims, 2 Drawing Figures

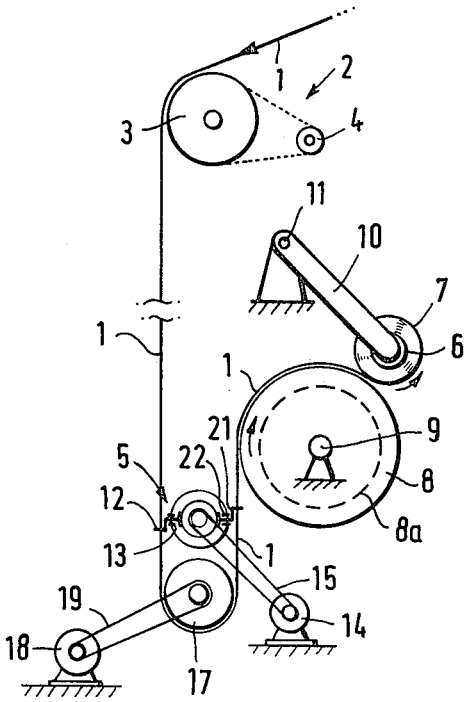
FIG.1
FIG.2
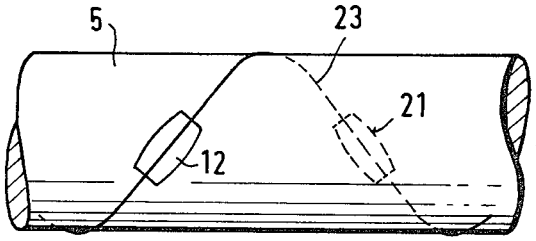

THREAD REELING APPARATUS

FIELD OF THE INVENTION

This invention relates to an apparatus for reeling a thread or the like onto a bobbin the thread is guided by a thread guide assembly traversing along a rotary cam drum. The thread reels onto a bobbin which is rotated by a friction roller. A tension controlling assembly is mounted between the rotary cam drum and the bobbin to control thread tension during the reeling or winding operation.

BACKGROUND OF THE INVENTION

During reeling of a thread through a thread guide moving to-and-fro along a bobbin, tension and the speed of the thread fluctuates for various reasons. At the points of reversal of the traversing, the angle of inclination of the helical groove in the rotary cam drum changes to zero and then increases in the return direction to a maximum value. Due to the change in the angle of the inclination, the thread speed continually changes during the to-and-fro movement of the thread. However, even though the thread speed changes, the peripheral speed of the bobbin on which the thread is reeled remains constant. Consequently, the tension of the thread varies considerably as it is reeled onto the bobbin.

The effect of the so-called thread triangle is to bring about a change in the speed of the thread during the to-and-fro movement of the thread. The thread triangle is defined by the two points of reversal of the thread guide member of the thread guide assembly and the upper fixed point in the thread guidance which is situated in general at a spacing above the middle of the traversing travel of the thread guide member. This spacing or length of the helical groove between the reversal points should be as large as possible for the reduction of the speed differences along the thread lengths travelling through the thread triangle. In general, the spacing amounts to two to four times the traverse which is the shortest distance between the two reversal points. When the thread guide member moves from the middle of the traverse to one extreme position of the same, the distance between the thread guide and the fixed point increases. Thus, because of this variation, there is an increase in the speed of the thread as the bobbin revolves with a constant peripheral speed. The same applies in the contrary sense with opposite movement of the thread from the end point of the traverse to the middle of the traverse.

The thread is supplied from a processing machine to the reeling assembly at a constant speed. The thread tension continuously changes because of the above-described unavoidable speed variations during the reeling or winding procedure. The effect of such tension changes can also be observed in the product manufactured with the thread. Because of the high cost and large overall size requirements, the so-called thread triangle cannot be made very long. As a result, the so-called triangular tension becomes intolerable during very high thread speeds. As a thread speed increases, additional tension is introduced to the thread due to air friction.

Repeated attempts have been made to overcome these difficulties. In one well known apparatus, the thread is lead around two godets which are driven at a speed higher than the speed of the friction roller. With this known apparatus, the drives must be coordinated in total synchronization with respect to each other. There is a considerable consumption of power in this known apparatus. With lesser overall height of the thread triangle, there exists the danger that the length available for the stretching of the thread is sufficient thereby count fluctuations may arise.

In another known apparatus, a grooved roller is connected downstream of the thread guide of the rotary cam drum. The thread is led directly to the reeling bobbin from the grooved roller. The groove is deeper at the points of reversing than between the latter. The purpose of such grooved roller is to reduce the high triangular tension resulting from guiding the thread in the thread triangle. There are several drawbacks with such grooved rollers. The preparation with which the thread is invested deposits in the grooves, so that the guidance through the groove is uncontrollably changed. Relatively early wear occurs at the groove bottom surface. The direct passing of the thread from the grooved roller to the thread package may impair the product of the winding. Furthermore, the rotational speed of the grooved roller has to be in a certain relationship with respect to the rotational speed of the rotary cam drum or the traversing device. Operation of this combination is tied to a precise relationship of the relative speeds.

SUMMARY OF THE INVENTION

The primary object of this invention is to control the tension of the thread between the rotary cam drum and the thread bobbin. The invention eliminates the triangular tensions resulting through the thread triangle in a simple and sure manner with the reeling or winding of the thread onto the thread package being done with a reduction in the thread tension. The thread reeling apparatus of this invention includes a roller having a smooth peripheral surface being located downstream in the direction of thread travel from the traversing thread guide assembly moving to-and-fro along the length of a rotary cam drum. The smooth roller may be driven with a different peripheral speed i.e. greater or lesser, than the friction roller which drives the bobbin or thread package.

With the thread reeling or winding apparatus of the present invention, the thread is delivered from the guide member of the thread guide assembly to the thread package in an efficient manner. The thread is placed on the bobbin in a desired fashion with an assurance that the package build-up on the bobbin is clean. The so-called triangular tensions are intercepted and reduced by the smooth roller so that the thread progresses without triangular tensions. The so-called whipping of the thread at the thread triangle cannot be observed on the thread package. Hard edges are no longer produced in the thread package.

The thread is delivered to the friction roller free of disorders. The interposed smooth roller is not liable to any wear phenomena while in service. The thread coming off the traversing thread guide assembly at the rotary cam drum may be placed on the smooth roller at any position. The preparation present on the thread has no opportunity to settle upon the smooth periphery of the interposed roller. The smooth intermediate roller also operates as a delivery roller so that other delivery devices, for example, godets, are not required. Also, there is an agreeable and practical service level for the bobbins at the end of a relatively large length of the thread triangle.

The supply of the thread for the reeling or winding procedure on the bobbin is kept constant. The rotational speed of the rotary cam drum may be selected independently of the peripheral speed of the intermediate smooth roller. This enables one to make use of the best crossing angle at the reeling or winding bobbin. Intentional fluctuations in the rotational speed of the rotary cam drum (commonly referred to as wobbling) neither affect the rotational speed of the intermediate smooth roller nor the thread tension. Thus, the present apparatus contributes to a gentle treatment of the thread.

In accordance with a further feature of the invention, the first thread guide assembly is disposed to lead the further thread guide assembly along the length of the rotary cam drum. The length of the lead should lie in the region of a half a pitch of the helically-extending groove in the rotary cam drum. The course taken by the thread on the smooth roller is along a portion of the helix. The angular tensions introduced by the rotary cam drum are eliminated on the roller. Thus, a smooth movement of the thread is obtained on the second thread guide assembly after leaving the smooth roller.

A further feature of the invention is to have the friction roller disposed between the further thread guide assembly and the bobbin or thread package on which the thread is being wound. The drag path of the thread from the further thread guide assembly to the friction roller is kept short. Before the thread runs onto the bobbin, the bobbin is perfectly stabilized by resting against a part of the friction roller periphery. Consequently, there is a very clean delivery of the thread to the bobbin thereby providing an efficient bobbin build-up.

The first and further thread guide assemblies may be fitted to the periphery of the same rotary cam drum and located essentially on opposite sides of the cam drum with respect to each other. However, it is possible that a further rotary cam drum may be used to effect the drive of the further thread guide assembly. In this instance, a drive mechanism would be necessary to synchronize the rotation of the first and second rotary cam drums.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 is a diagrammatic elevational view of an apparatus for reeling a thread or the like on a bobbin made in accordance with this invention;

FIG. 2 is a diagrammatic elevational view of a detail at the rotary cam drum.

DETAILED DESCRIPTION

Figure 3:
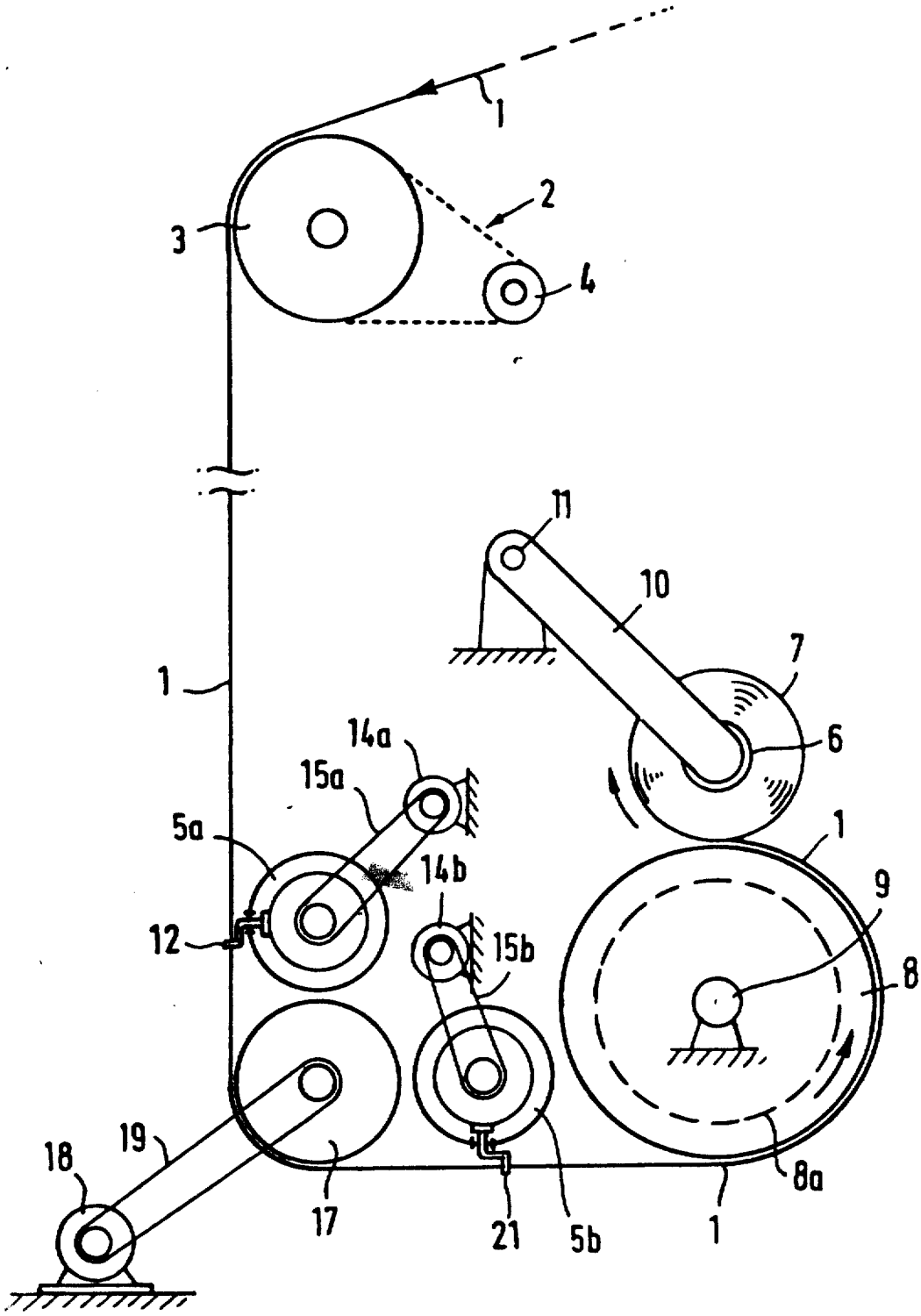

A delivery device 2 having rollers 3 and 4 directs a thread 1 to a rotary cam drum 5 so that thread 1 can be reeled on bobbin 6 to form a thread package 7. Delivery device 2 operates at a constant speed of rotation. Friction roller 8 drives bobbin 6 or thread package 7. Friction roller 8 may be formed as a motorized roller with a motor 8a and is supported on a stationary shaft 9. Bobbin 6 is mounted on swing arm 10 which swings outwardly about fixed spindle 11 as a function of the increase of diameter of thread package 7. Swing arm 10 also biases bobbin 6 against friction roller 8.

A thread guide 12 traverses rotary cam drum 5 which includes groove 23 having a helical course. Thread guide 12 includes a groove follower which engages groove 23 and is consequently guided along the length of rotary cam drum 5. Thread guide 12 travels continually to-and-fro as the groove follower 13 moves along groove 23. Motor 14 drives rotary cam drum 5 through a transmission belt 15.

Thread 1 is carried around a roller 17 located in the path of the feed of thread 1 to bobbin 6 or thread package 7. Roller 17 has a smooth peripheral surface and is located downstream of rotary cam drum 5 with its traversing thread guide 12 and groove follower 13. Roller 17 may be driven at a different speed or number of revolutions per unit of time than friction roller 8.

For example, roller 17 may be driven at a higher rate of speed than friction roller 8. If friction roller 8 has a peripheral speed of 4,000 rpm, roller 17 may maintain a greater, the same or a lesser peripheral speed. Motor 18 drives roller 17 through transmission member 19. When friction roller 8 has a lesser peripheral speed than roller 17, the thread tension in thread 1 is reduced.

A further thread guide assembly 21 is mounted to traverse the same rotary cam drum 5 as the traversing thread guide assembly 12. Thread guide assembly 21 directs thread 1 at a location following roller 17. The thread guide assembly 21 includes a groove follower in a manner well known in the prior art which engages groove 23 and slides along the assembly guide 22 and along the length of rotary cam drum 5. The first traversing thread guide assembly 12 is arranged to lead the second traversing thread guide assembly 21. In this specific embodiment, the amount of lead is one half a pitch of the helically shaped groove 23.

Thread 1 can be placed by the guide member of the traversing thread guide assembly 21 on the periphery of friction roller 8. Thread 1 takes its course on this periphery over a certain distance until it reaches thread package 7 which is propelled by friction roller 8. Thus, the guide element of the further traversing thread guide assembly 21 provides a very careful delivery of thread 1 to bobbin 6 or thread package 7 or to friction roller 8. In the latter case, a particularly short drag path of thread 1 through the air is achieved.

The interpositioning of the further traversing thread guide assembly 21 guarantees an accurate placing of thread 1, first of all, on friction roller 8 and, thereafter, also on thread package 7. The so-called triangular tensions originating from the thread triangle, i.e. from the course taken by thread 1 at the upper part of traversing thread guide assembly 12, are completely eliminated when thread 1 is laid on smooth-surface roller 17 and further guided by the guide member of thread guide assembly 21.

Thread 1 can be laid without any hindrance or interruption on the smooth periphery of the interposed roller 17. Consequently, thread 1 may be adapted to the usual known intentional fluctuations in the speed of the thread guide (the so-called wobbling procedure). A complete structural arrangement can be maintained as hitherto so that the height of the so-called thread triangle can remain within the operating height. The thread triangle can also, in itself, occupy a sufficient height so that a sufficient elasticity is also available in thread 1. Thread guide assembly 21 may also be actuated from a further independent rotary cam drum which rotates in synchronization with the first rotary cam drum 5.

A respective motor is, of course, for rotary cam drum 5, roller 17 and friction roller 8. The rotational speeds may be kept in a predetermined ratio one with respect to another. In this way, a substantially improved operation for the reeling of thread 1 is achieved and very high speeds can be used without impairment of the operation through excessive thread tension.

While the thread reeling apparatus has been shown and described in detail, it is obvious that this invention is not to be considered as being limited to the exact form disclosed, and that changes in detail and construction may be made therein within the scope of the invention, without departing from the spirit thereof. The peripheral surface of the smooth roll may be of a slightly cambered design in direction of the longitudinal axis.

Having thus set forth and disclosed the nature of this invention, what is claimed is:

1. An apparatus for reeling thread on a bobbin, said apparatus comprising:

(a) a rotary cam drum having a helical groove extending along the longitudinal axis thereof, (b) a first traversing thread guide assembly mounted to move along said helical groove and effective to guide the thread to-and-fro along the longitudinal axis of the rotary cam drum, (c) tension controlling means located between the rotary cam drum and the bobbin to receive the thread from the first traversing thread guide assembly for controlling the tension of the thread, and (d) a friction roller for rotating the bobbin, (e) said tension controlling means including a smooth roller located downstream from said first traversing thread guide assembly for receiving a thread on its smooth peripheral surface and a second traversing thread guide assembly between the smooth roller and the friction roller, (f) said second traversing thread guide assembly being effective to guide the thread between the smooth roller and the friction roller.

2. An apparatus as defined in claim 1 wherein said tension controlling means includes a means for driving the smooth roller at a different peripheral speed than the friction roller.

3. An apparatus as defined in claim 1 wherein said second traversing thread guide assembly is mounted to move in said helical groove of the rotary cam drum at a location circumferentially spaced from the first traversing thread guide assembly.

4. An apparatus as defined in claim 1 wherein said tension controlling means includes a further rotary cam drum having a helical groove extending along the longitudinal axis thereof, said second traversing thread guide assembly mounted to move along the helical groove of said further rotary cam drum and effective to guide the thread to-and-fro along said further rotary cam drum, said further rotary cam drum being driven in synchronism with said first rotary cam drum.

5. An apparatus as defined in either claim 3 or 4 wherein said first thread guide assembly leads the second traversing thread guide assembly during the to-and-fro movement along the length of a rotary cam drum.

6. An apparatus as defined in claim 5 wherein the length of the lead is about a half a pitch of the helical groove.

* * * * *

UNITED STATES PATENT AND TRADEMARK OFFICE

CERTIFICATE OF CORRECTION

PATENT NO. : 4,379,528

DATED : April 12, 1983

INVENTOR(S) : Alfred Tschentscher

It is certified that error appears in the above-identified patent and that said Letters Patent is hereby corrected as shown below:

Figure 3 should be added as shown on the attached sheet.

On the title page "2" Drawing figures" should read -- 3 Drawing figures --.

Signed and Sealed this

*Twenty-first* Day of *May 1985*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,379,528

DATED : April 12, 1983

INVENTOR(S) : Alfred Tschentscher

It is certified that error appears in the above-identified patent and that said Letters Patent is hereby corrected as shown below:

Column 3, line 57, after "drum" delete the period (.) and insert therefor --;--.

after line 57, insert

--FIG. 3 is a diagrammatic elevational view of another embodiment of the invention.--

Column 5, after line 9, insert

--The embodiment of Figure 3 shows two rotary cam drums 5a and 5b with a respective traversing thread guides 12 and 21 mounted to move along the respective helical groove in cam drums 5a and 5b. The combination of motor 14a and belt 15a drives cam drum 5a. The combination of motor 14b and belt 15b drives cam drum 5b in synchronism with cam drum 5a. In this embodiment, during its to-and-fro movement along the length of rotary cam drum 5a, thread guide assembly 12 leads the traversing thread guide assembly 21 in its respective movement along rotary cam drum 5b.--